United States Patent [19]

Keast

[11] Patent Number: 4,790,582

[45] Date of Patent: Dec. 13, 1988

[54] CONCEALED WINDOW LOCK

[76] Inventor: Edward Keast, 106 Cambridge Dr., Glen Mills, Pa. 19342

[21] Appl. No.: 914,658

[22] Filed: Oct. 2, 1986

[51] Int. Cl.[4] ..... E05C 19/18

[52] U.S. Cl. ..... 292/288; 292/DIG. 47

[58] Field of Search ..... 292/288, 144, 244, 156, 292/162, 138, 32, 42, DIG. 47

[56] References Cited

U.S. PATENT DOCUMENTS

| | | | |
|---|---|---|---|
| 56,431 | 7/1866 | Myers et al. | 81/3.47 |
| 480,414 | 8/1892 | Puccini | 81/3.47 |
| 485,070 | 10/1892 | Travis | 292/327 |
| 1,396,478 | 11/1921 | Turney | 70/90 |
| 1,580,611 | 4/1926 | Kirkpatrick | 70/90 |
| 2,076,897 | 4/1937 | Kistner | 70/90 |
| 2,537,049 | 1/1951 | Glatt | 292/138 |
| 2,809,062 | 10/1957 | Mainhardt | 292/144 |
| 3,501,932 | 3/1970 | Bishop | 70/90 |
| 3,642,315 | 2/1972 | Alpern | 292/144 |
| 4,068,506 | 1/1978 | Phelps | 292/288 X |
| 4,235,464 | 11/1980 | Cantley | 292/288 |
| 4,351,170 | 9/1982 | Clompus | 70/90 |
| 4,400,027 | 8/1983 | Nahon | 292/288 |

*Primary Examiner*—Richard E. Moore

*Attorney, Agent, or Firm*—Moyerman & Moyerman

[57] ABSTRACT

A removable and concealable lock for sliding sash windows has two parts—a solid cylindrical bolt and an extractor pin. The extractor pin is an elongated pin with grasping means at one end and a perpendicular bend at the opposite end. The bolt has a longitudinal channel in at least one end with at least one radial channel leading into the inner end of the longitudinal channel. The other bolt end is either tapered or greatly bevelled for easy insertion into predrilled window channels. The window channels are drilled through the overlapping rails or stiles of the window sashes. The bolt is inserted into the channels to lock the window in either an open or closed position. To remove the lock, the extractor pin is inserted into the longitudinal channel until its bent end locks into a radial channel. The pin then pulls the bolt from the channel.

3 Claims, 1 Drawing Sheet

CONCEALED WINDOW LOCK

BACKGROUND OF THE INVENTION

Field of the Invention

This invention relates to locks for windows and more particularly to locks for a window with sliding sashes.

Description of the Prior Art

In most sliding sash window installations, the window locks are placed on the top rail of the lower sash, visible to the outside and easily turned if the pane is broken. The conventional window lock is also "easily" broken by prying at the window. Many devices have been devised to make a safer window lock either by concealing it or by requiring a key for unlocking it. Many of these devices use a housing in the window sash into which a rod is inserted. Alpern (U.S. Pat. No. 3,642,315) uses a second magnetized rod to remove the first rod. Kirkpatrick (U.S. Pat. No. 1,580,611), Kistner (U.S. Pat. No. 2,076,847) and Bishop (U.S. Pat. No. 3,501,932) employ rods inserted into housings having springs, and are all unlocked with flat keys which engage slots in the proximate rod end.

Glatt (U.S. Pat. No. 2,537,049) uses a preinserted rod/bolt in a window channel which is screwed into and out of a locking position by a key. Turney (U.S. Pat. No. 1,396,478) is another rod-like lock which requires a housing for the rod. Clompus (U.S. Pat. No. 4,351,170) also uses a key operated bolt which is inserted into a plug placed on overlapping window portions.

Phelps (U.S. Pat. No. 4,068,506) has a hollow tube lock concealed in channels in overlapping window sashes. The tube is removed by a key inserted into slots in the wall of the tube. The ends of the tube are straight cylinder ends.

With Phelps' device and with many of the previously mentioned devices, it is difficult to align the predrilled window channels in such a manner as to allow easy insertion of the rod. If the window channels are not exactly aligned to each other, the flat end of Phelps' lock (for an example) will not slide directly into the channel in the second window member. Yet, if the channels are drilled much larger than the rod, the rod will come out without needing the key.

There is therefore a need for a concealed window lock which combines security with ease of operation, which requires no installation of housing for the lock, and which will be easily inserted and removed from predrilled window channels.

SUMMARY OF THE INVENTION

The prior art problems are obviated by the concealed window lock of this invention which has two parts—a removable, solid, cylindrical bolt with tapered or bevelled ends and an extractor pin. For locking purposes a window is prepared to receive the window lock by drilling a channel into and through the aligned rails of two sliding sash windows. To hold a window in an open but locked position, aligned channels may also be drilled through the stile of the upper sash. The bolt member is preferably a solid cylinder for security, and has either two bevelled (or tapered) ends or one non-tapered and one tapered end for ease of insertion. At least one end has a longitudinal channel drilled inward from the bolt end along the longitudinal axis of the bolt. At least one radial channel reaches from the bolt exterior into the inner end of the longitudinal channel. The locking bolt is inserted into the predrilled window sash channels (concealed within the channel) securing the window. The extractor pin is preferably elongated with grasping means on one end and bent perpendicularly at the other end. The bent end is inserted into the exterior end of the bolt's longitudinal channel until it hooks into the radial channel and locks into place. The extractor pin then pulls the bolt from the window channel.

It is, therefore, an object of this invention to provide a concealed window lock which is easy to use and still provides maximum security.

It is another object of this invention to provide a concealed window lock with tapered or bevelled ends so that it is easy to insert into predrilled window channels, even when the window sashes are not perfectly aligned.

It is still another object of this invention to provide a concealed window lock in which the extractor pin locks into one of several radial channels for quick removal of the locking bolt.

It is yet another object of this invention to provide a concealed window lock which is not visible from the outside.

It is a further object of this invention to provide a concealed window lock which may be used to lock a window in an open position as well as a closed position.

It is yet a further object of this invention to provide a concealed window lock which uses an extractor which is concealed to a further degree.

These and other objects will be more readily ascertainable to one skilled in the art from a consideration of the following Figures, description and examplary embodiments.

BRIEF DESCRIPTION OF THE DRAWING(S)

DETAILED DESCRIPTION OF THE PREFERRED EMBODIMENT

Figures 1, 2, 3, 4, 5, 6, 7, 8:
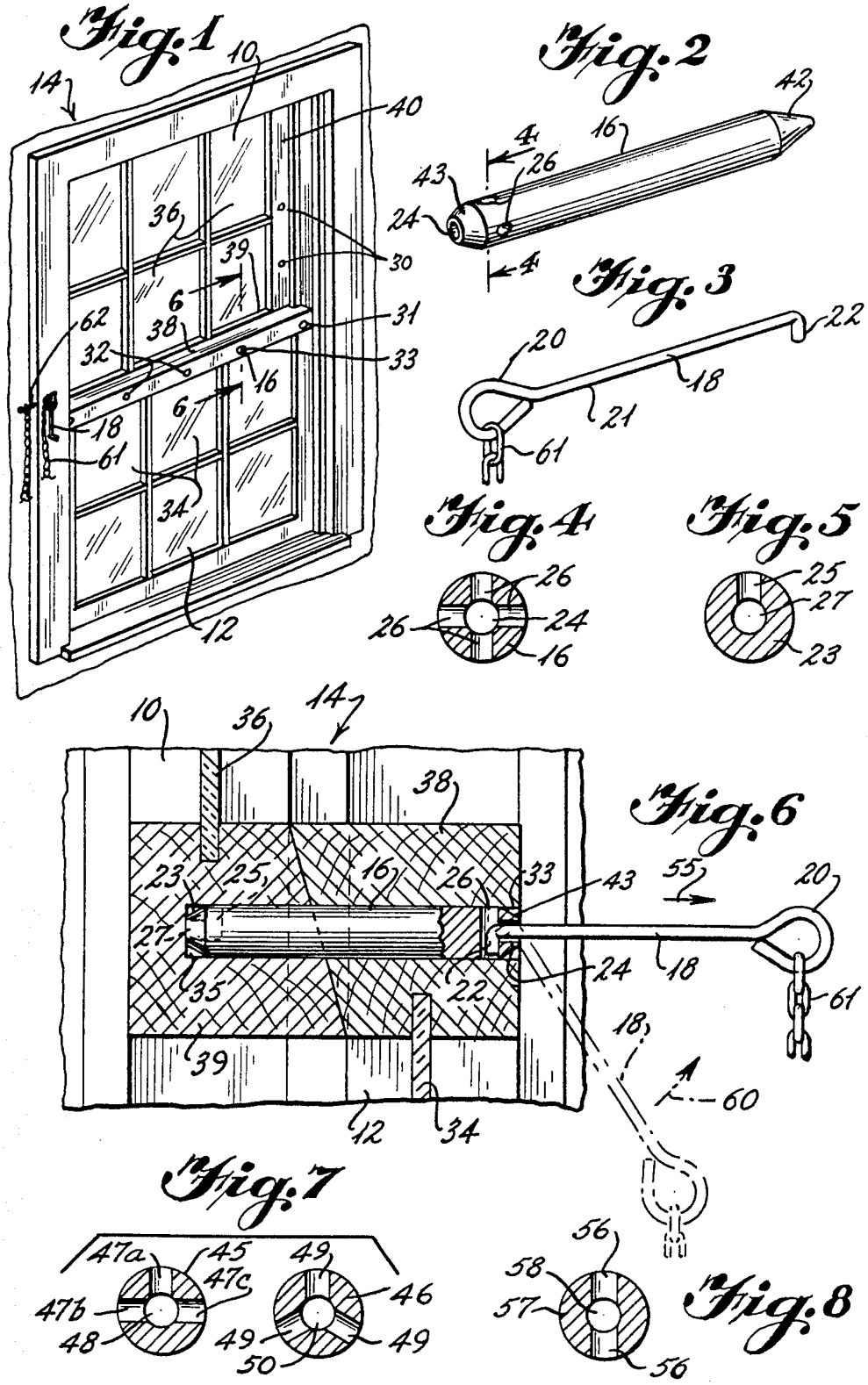
FIG. 1 is an isometric view of a sliding sash window with predrilled window channels, the lock of this invention concealed in one of the channels, the extractor pin hanging out of view on the window frame.
FIG. 2 is an isometric view of the preferred cylindrical bolt of the window lock of this invention.
FIG. 3 is an isometric view of the extractor pin of this invention.
FIG. 4 is a cross section of an end of the bolt taken on lines 4—4 of FIG. 2.
FIG. 5 shows an alternative end to FIG. 4.
FIG. 6 is a cross section taken on lines 6—6 of FIG. 1 showing the window with the bolt in locking position.
FIG. 7 shows cross sections of bolts with three axial holes.
FIG. 8 is a cross section of another alternative embodiment of a bolt end.

Now referring to the drawings, and more particularly to FIG. 1, window 14 is shown adapted with channels 30, 31, 32 and 33 to receive removable window lock bolt 16. It should be noted that in the drawings and descriptions, this invention is described as it is used with a conventional double-hung window. It should be understood that bolt 16 may be used equally as well with sliding windows, sliding doors or other types of overlapping windows and doors.

It should also be understood that window 14 is illustrative only and that only one set of channels 31, 32 or 33 is preferred to be used at one time, location of channels according to user preference. It is also illustrative that the extractor pin is concealed on the window frame. Although pin 18 is shown on the front of the frame, another preferred location would be on nail 62 on the edge of the frame.

In FIG. 1, window 14 is a typical double-hung window with upper sash 10 having panes 36, lower rail 39 and stile 40 with channels 30. Lower sash 12 is seen having panes 34 and top rail 38 which includes channels 32, 31 and 33. Inserted into channel 33 is lock bolt 16 which is better seen in FIGS. 2 and 6.

Window 14 is illustrated in its closed and locked position. By closing sashes 10 and 12, channels 31, 32 and 33 align with the unseen but matching channels in bottom rail 39 of upper sash 10. A lock bolt is then inserted into a channel (in this case channel 33) until its near end is either completely inside channel 33 or just flush with the outer edge of upper rail 38. The construction of the window channels is best explained with reference to FIG. 6.

The safe locking of window 14 is illustrated in FIG. 1. First, unlike conventional double sash window locks, no lock is visible from the outside of window 14. Second, lock bolt 16 is completely concealed within channel 33. Not only is it not visible from the outside, but even if window panes are broken, it cannot be extracted from channel 33 by fingers, pliers or other devices, except for extractor pin 18. When extractor pin 18 is hung on the window frame side as illustrated, it also is not visible from the outside. It is preferred to have an extractor pin at each window for quick unlocking in an emergency. Additionally, chain 61 may be fastened to nail 62 and pin 18 so that extractor pin 18 is always readily available.

Lastly, when bolt 16 is inserted into a window as illustrated, the window cannot be moved up or down, even if the window panes are removed. Bolt 16 is preferably a strong, solid metal cylinder which will hold the window sashes in place even when force is exerted on them.

Window 14 is illustrated with channels 30 in stile 40 to provide for locking of window 14 when it is open. When sash 10 is lowered or sash 12 raised so that one of channels 30 in stile 40 and channel 31 in rail 38 are aligned, bolt 16 is inserted to hold and lock window 14 in its open position. Again, the window is secure from intruders because it is locked with concealed bolt 16.

Now referring to FIGS. 2 and 4, bolt 16 is illustrated with tapered end 42 and end 43 which is either bevelled to a small chamfer or is squared. Bolt 16 is preferably tapered on at least one end. It may be bevelled at one end instead of tapered (as is shown in FIG. 2), but it is never flat. Either tapering or bevelling provides for easy insertion and it also solves a problem found in the prior art. In previous insertable bolts, exact alignment of window channels was absolutely necessary since a portion of the straight flat end of the bolt often hit the window surrounding the channel and prevented further insertion of the bolt. In particular, greatly tapered end 42 helps to align the channels. When a part of end 42 hits the channel, the tapered bolt end 42 will easily slide into the channel, the bolt itself forcing the windows into alignment as it slides into the channel. Also, because bolt 16 is a solid cylinder, it will not be bent when it pushes against a window edge as might be the case in the prior art.

Additionally, when one bolt end is greatly tapered, as is end 42, that end preferably has no channels for the extractor pin. Thus, it can be very greatly tapered since it does not need to provide space for channels. The greater the tapering, the better the bolt is able to solve the problem of misaligned window channels.

In FIGS. 2 and 4, bevelled bolt end 43 of bolt 16 has longitudinal channel 24 and four radial channels 26. Greater security may be provided by having only one radial channel (as is shown in alternative end 23 of FIG. 5). However, for ease and speed of bolt removal, it may be preferred to have a choice of radial channels. The number and arrangement of channels is decided by user preference or manufacturing requirements. In FIG. 5, only one axial channel 25 enters into longitudinal channel 27 of bolt end 23.

FIGS. 2, 4 and 5 illustrate the placement of channels as well as the fact that bolt 16 is preferably a solid cylinder. A solid, strong metal cylinder provides the strength necessary to make bolt 16 an effective security device. Additionally, longitudinal channels 24 and 27 are sized to have a diameter and length to receive a bent end of an extractor pin (seen in FIGS. 3 and 6). Channels 24 and 27 must end at the point where axial channels 25 and 26 enter, or extractor pin 18 will reach too far and not lock into position.

Now referring to FIG. 3, extractor pin 18 is seen with grasping loop 20, elongated section 21 and bent end 22. Operation of extractor pin 18 is best explained in reference to FIG. 6. Arrangement of chain 61 is seen fastened to loop 20.

Now referring to FIG. 6, extractor pin 18 is illustrated being used to pull bolt 16 from its position in window channels 33 and 35. For purposes of illustration, in this embodiment, bolt 16 has two bevelled ends instead of one tapered end and one bevelled end. End 43 is shown as in FIG. 2, but end 42 is shown replaced by end 23 of FIG. 5. Window 14 has been drilled to align channel 33 in top rail 38 of lower sash 12 and channel 35 in lower rail 39 of upper sash 10. Panes 34 and 36 are seen held in rails 38 and 39, respectively. End 23 of bolt 16 has reached the inner end of channel 35 and bolt 16 is completely concealed inside channels 33 and 35 with the extreme outer edge of end 43 flush with the outer edge of rail 38.

Extractor pin 18 is seen in phantom in the position necessary for insertion of bent end 22 into longitudinal channel 24. While inserting end 22 into longitudinal channel 24, a user rotates pin 18 slightly until end 22 slips into a radial channel 26. When end 22 is in radial channel 26, pin 18 can be raised in the direction of arrow 60 to the horizontal position illustrated. In this straight position, end 22 locks into radial channel 26 and will not slip out when pin 18 is pulled, in the direction of arrow 55, to pull bolt 16 out of the window. The precise sizing of bolt channels to mated extractor pin size provides for the locking of pin end 22 into channel 26 for sure and steady removal of bolt 16 from the window.

In operation, to open the window, bolt 16 is pulled outward in the direction of arrow 55, far enough to clear all of channel 35. Bolt 16 may also be pulled out of channel 33, but it is best if it is left in channel 33 for fast and simple re-locking of the window.

Now referring to FIG. 7, cross sections of alternative bolt ends 45 and 46 are shown. Bolt end 45 has been drilled to have longitudinal channel 48 into which leads three radial channels **47*a*, 47*b* and 47*c*. Channels 47*b* and 47*c* may be drilled as one channel straight through bolt end 45. Bolt end 46 is drilled with three separate radial channels 49 and longitudinal channel 50**.

FIG. 8 illustrates still another alternative placement of radial channels. Two diametrically opposed channels 56 extend through longitudinal channel 58. Bolt end 57 of FIG. 8, end 45 of FIG. 7 and end 43 of FIGS. 2 and 4 may be easily drilled because of opposing radial channels. However, choice of number and placement of the radial channels in bolts 16 (FIGS. 1, 2, 4 and 6) and bolt ends 46, 45 and 57 is dependent upon the facility of manufacture or user preference.

There are several advantages to placement of radial channels in various patterns. Having only one radial channel offers the most security to the user. Having three or four radial channels provides the quickest unlocking of a window. Any combination of radial channels leading into the longitudinal channel is within the scope of this invention.

Grasping end 20 of extractor pin 18 is shown as a loop, but any shape which facilitates handling of the extractor pin is suitable and within the scope of this invention.

There are several advantages to the removable lock of this invention. First, it provides a completely safe and concealed lock for a number of window styles.

Second, it is capable of locking a window in either an open or a closed position.

Also, the tapering of bolt ends prevents the bolt of this invention from jamming against the second sash. Further, the tapering of the bolt encourages the bolt's entrance into the second channel and actually helps to align the two window channels.

Having now described by invention, it is not my intention that such description limit the invention, but that the invention be limited only by a reasonable interpretation of the appended claims.

What is claimed is:

1. A removable window lock comprising:

(a) a removable, solid, generally cylindrical bolt having two ends, one of said bolt ends being tapered, said bolt including on the opposite end a set of channels, one longitudinal channel extending from said bolt end's center inward along said cylinder's longituidnal axis a predetermined distance and, at least one radial channel located inwardly of the end of said cylinder and opening into said longitudinal channel, said channel's diameters and lengths sized to workably receive and positively lock together with an extractor pin; and (b) an elongated extraction pin having grasping means at one end, said pin's other end bent perpendicularly, said bent pin section sized relative to said channels to be inserted through said longitudinal channel and then into said radial channel, such that when said pin abuts a surface of said longitudinal channel, said bent end oppositely extends into at least a portion of said radial channel whereby, when said bolt is fully inserted into a predrilled channel in a set of window sashes, said sashes are locked in place until said extractor pin is inserted into said bolt's radial channel to permit said pin bent end to hook and positively lock itself into said radial channel and thereby pull said bolt from the window.

2. A removeable window lock according to claim 1 wherein said bolt includes one end which is tapered to a point or almost a point.

3. A removable window lock according to claim 1 wherein said bolt and said extractor pin are dimensionally matched to provide positive locking of the extractor pin to the bolt when said pin is held substantially axially of said bolt.

* * * * *